United States Patent [19]

Hillberg et al.

[11] 4,407,085

[45] Oct. 4, 1983

[54] HANDGUN FIRING MECHANISM

[76] Inventors: Robert L. Hillberg, 26 Mount Sanford Rd., Cheshire, Conn. 06410; Frederick F. Stevens, 177 Brett Rd., Fairfield, Conn. 06430

[21] Appl. No.: 308,427

[22] Filed: Oct. 2, 1981

[51] Int. Cl.[3] ..... F41C 19/00

[52] U.S. Cl. ..... 42/69 R

[58] Field of Search ..... 42/8, 69 R, 42 R, 42 B, 42/65; 89/147

[56] References Cited

U.S. PATENT DOCUMENTS 1,348,035 7/1920 Mossberg ..... 42/8

FOREIGN PATENT DOCUMENTS 1185092 1/1965 Fed. Rep. of Germany ..... 89/147

*Primary Examiner*—Charles T. Jordan
*Assistant Examiner*—Ted L. Parr
*Attorney, Agent, or Firm*—McCormick, Paulding & Huber

[57] ABSTRACT

A multi-barrel, breach loaded pistol having a double action firing mechanism includes an L-shaped sear carried by the hammer and released from engagement with the trigger by engagement of a portion of the sear with the gun frame.

13 Claims, 5 Drawing Figures

HANDGUN FIRING MECHANISM

BACKGROUND OF THE INVENTION

This invention relates in general to firearms and deals more particularly with a handgun having an improved double action firing mechanism which includes a trigger, a movable hammer, and a sear engageable with the trigger. In a handgun of this type, drawing back the trigger causes the hammer to move to a tripping position against the biasing force of a mainspring. At the tripping position the sear disengages from the trigger permitting the hammer to move freely to its striking position in response to the biasing force of the mainspring. In a mechanism of the aforedescribed general type coengageable cam surfaces are usually provided on the trigger and the sear to effect disengagement of the sear from the trigger at the tripping position. However, play between various parts of the mechanism resulting from accumulated manufacturing tolerances and/or wear may cause premature release of the sear from the trigger. This condition results in release of the hammer before the mainspring is fully compressed so that potential energy stored in the mainspring is seriously reduced. This problem is particularly severe in a small handgun, such as a derringer of the so-called "hammerless" type wherein the hammer is concealed within the gun frame and has relatively little room for travel. Premature release of the hammer in a gun of this type is likely to result in misfire. The present invention is concerned with this problem.

SUMMARY OF THE INVENTION

In accordance with the invention an improved firing mechanism is provided for a handgun which has a frame, a trigger supported on the frame for movement between ready and firing positions, and a hammer assembly supported on the frame and including a hammer and a sear carried by the hammer and engageable with the trigger to effect movement of the hammer to a tripping position in response to movement of the trigger from its ready to its firing position. In accordance with the invention there is provided means for maintaining the sear in engagement with the trigger during movement of the trigger from its inactive to its tripping position, and means independent of the hammer and the trigger and engageable with the sear for effecting release of the sear from the trigger at the tripping position.

DETAILED DESCRIPTION OF PREFERRED EMBODIMENT

Figure 1:
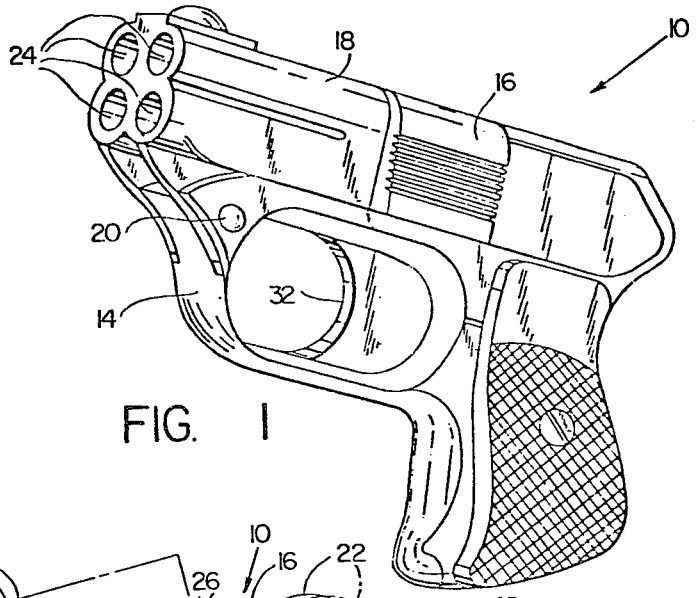
FIG. 1 is a perspective view of a handgun embodying the present invention.

Referring now to the drawing, a multi-barrel, breech loaded handgun or pistol embodying the present invention is indicated generally by the reference numeral 10.

The illustrated gun 10 has an improved firing mechanism of the double action type, indicated generally by the reference numeral 12, which is capable of moving a hammer to and releasing it in a tripping position to fire the gun in response to a single pull of a trigger. Pressure on the trigger must be released after each shot is fired to enable the firing mechanism to engage for the next shot.

The pistol 10 generally comprises a frame 14 which has a breech portion 16. A barrel assembly 18 is pivotally supported at the forward end of the frame by a hinge pin 20 to break upwardly and away from the breech portion to an open position, such as indicated in broken lines in FIG. 2, upon rearward movement of a releasing latch indicated at 22 and associated with the pistol rear sight. The illustrated barrel assembly 18 has four integral barrels, as shown in FIG. 1. Each barrel has a bore 24 which includes a chamber 26 at its breech end. The chambers are closed by the breech portion 16 when the barrel assembly is latched in its closed position relative to the frame, as it appears in FIG. 1. The barrel assembly may also include an extractor mechanism which operates in a manner well known in the art to extract spent cartridges from the chambers 26, 26 when the barrel assembly 18 is broken upwardly to an open position relative to the frame 14. However, for clarity of illustration, the extractor mechanism Fs not shown.

Figure 5:
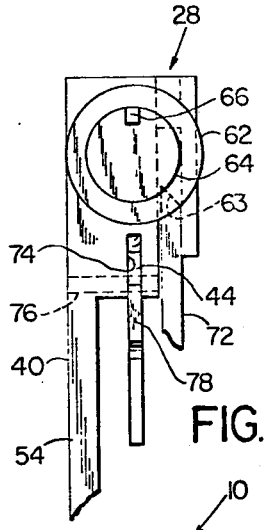
FIG. 5 is a fragmentary front elevational view of the hammer assembly shown in FIG. 4.

The firing mechanism 12 is arranged for rim fire and includes a hammer assembly indicated generally at 28, a mainspring assembly designated generally by the numeral 30 and a trigger 32. The trigger is slidably supported in opposing upper and lower ways formed in the frame 14 for movement between a ready position shown in full lines in FIGS. 1 and 2 and a firing position indicated by broken lines in FIG. 3. The rear upper portion of the trigger 32 has a rearwardly facing bearing surface 34, for a purpose which will be hereinafter further evident. A lug 35 depends from the lower rear portion of the trigger and cooperates with the frame 14 to limit forward travel of the trigger 32. A trigger spring assembly which includes a trigger spring 36 and a spring guide rod 38 is received within a rearwardly opening bore in the trigger and acts between the trigger 32 and the frame 14 to normally bias the trigger in a forward direction toward its inactive or ready position. The hammer assembly, shown in further detail in FIGS. 4 and 5, generally comprises a hammer 40, a firing element, indicated generally at 42, and a sear 44 carried by the hammer. In accordance with the invention, the firing mechanism further includes a spring biasing mechanism 46 for biasing the sear 44 into and maintaining the sear in the path of the trigger and means independent of the trigger and engageable with the sear for releasing the sear from engagement with the trigger at the tripping position, as will be hereinafter further discussed.

Figure 2:
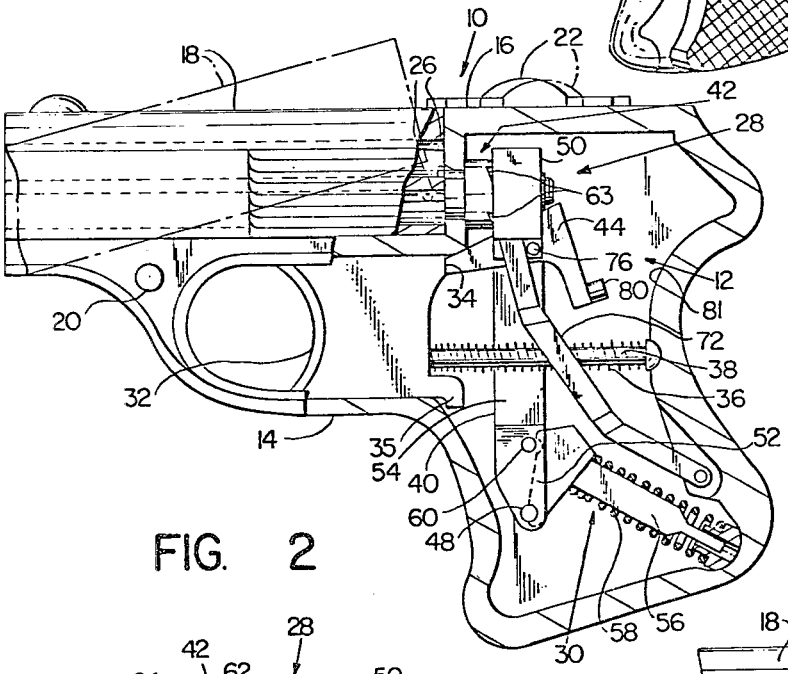
FIG. 2 is a somewhat enlarged side elevational view of the gun of FIG. 1 shown partially in longitudinal section.
Figure 3:
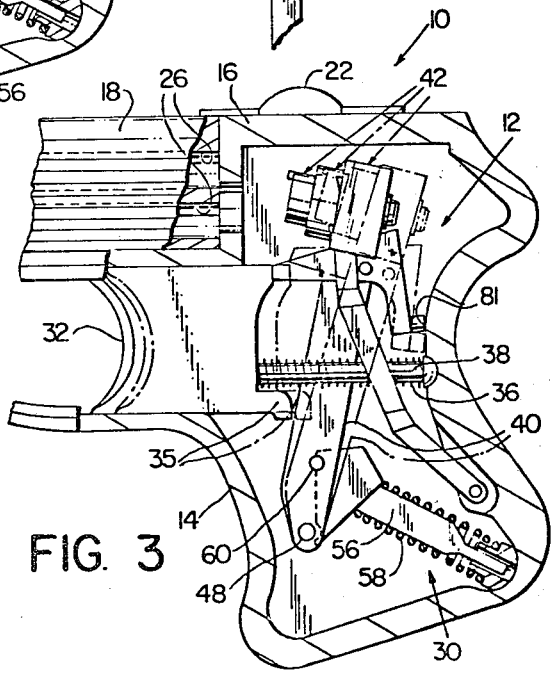
FIG. 3 is a fragmentary side elevational view similar to FIG. 2 but showing the firing mechanism in another position.

The hammer 40 comprises an elongated member pivotally supported at its lower end on a pivot pin 48, as shown in FIGS. 2 and 3, which extends transversely of the gun frames. The hammer has transversely enlarged upper and lower end portions, respectively indicated at 50 and 52, integrally joined by an elongated connecting portion 54 which extends along one side of the gun frame. A rearwardly opening slot in the lower portion 50 receives the forward end of the mainspring assembly 30 which includes a strut 56 and a mainspring 58 received on the strut. A pin 60 mounted in fixed position on the lower part 50 extends transversely of the slot therein and is engaged by the upper end of the strut 56, as best shown in FIGS. 2 and 3.

The firing element 42 has a generally cylindrical body portion 62. Four equiangularly spaced ratchet notches 63, 63 open outwardly through the rear peripheral surface of the body portion 62. Another cylindrical portion 64 of somewhat smaller diameter projects forwardly from the body portion 62 and carries a radially disposed firing lug 66. The firing element 42 is supported for rotation on and relative to the hammer 40 by an integral hub shaft 68 which projects rearwardly from the body portion 62 and which is received within a bore in the hammer upper portion 50. A retaining ring 70 engaged within an annular groove in the hub shaft 68 retains the firing element 42 in assembly with the hammer. An elongated hand or pawl 72 pivotally supported at its lower end on the frame 14 is spring biased in counterclockwise direction from its positions in FIGS. 2 and 3 and has an upper end arranged for sequential engagement with the ratchet notches 63, 63, as will be hereinafter further discussed.

Figure 4:
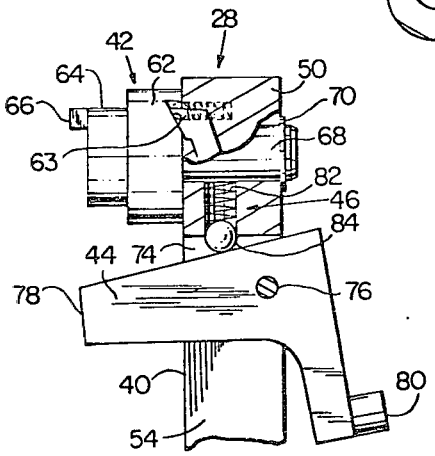
FIG. 4 is a somewhat enlarged fragmentary side elevational view of the hammer assembly.

The sear 44 is a generally L-shaped member which is supported within a downwardly opening slot 74 in the hammer upper portion 50. A pin 76 extends transversely of the upper portion 50 and through the slot 74 to support the sear proximate the junction of its legs for pivotal movement on and relative to the hammer 40, as best shown in FIG. 4. One leg of the sear has a forwardly facing abutment surface 78. The other leg has a rearwardly facing abutment surface 80 on its free end for engaging a bearing surface 81 on the gun frame. The spring biasing mechanism 46, which, as shown, comprises a spring 82 and a spherical ball 84 is received within a bore in the hammer upper portion 50 and acts between the hub shaft 68 and an associated leg of the sear 44 to bias the sear in a counterclockwise direction and toward its trigger engaging position, as best shown in FIG. 4.

Further disclosure of a ratchet or firing element and pawl mechanism, similar to the firing element 42 and pawl 72, and a mainspring assembly, similar to the mainspring assembly 30, may be found in the copending application of Robert L. Hillberg for MULTI-BARREL PISTOL, Ser. No. 111,870 filed Jan. 14, 1980. The latter application is hereby adopted by reference as part of the present disclosure.

When the trigger is in its ready position, as it appears in FIGS. 1 and 2, the hammer assembly 28 is in its forward position of FIG. 2 and the firing element 42 is at rest generally adjacent the breech 16. In the latter position of the trigger, the sear 44 is biased in counterclockwise direction by the biasing mechanism 46 to its trigger engaging position wherein the abutment 78 is disposed immediately rearwardly of and in alignment with the bearing surface 34. Drawing back on the trigger causes the hammer 40 to pivot in clockwise direction about the pivot pin 48, against the biasing force of the mainspring 58, as viewed in FIGS. 2 and 3. As the hammer pivots rearwardly toward its tripping position, shown in broken lines in FIG. 3, the pawl 72 engages an associated ratchet notch 63 to index the firing element 42 in counterclockwise direction, as viewed in FIG. 5. The sear 44 remains in engagement with the trigger until the abutment surface 80 on the sear engages the bearing surface 81 on the gun frame. The abutment surface 80 cooperates with the bearing surface 81 to provide means independent of the trigger for releasing the sear from engagement with the trigger. Thereafter, further pivotal movement of the hammer 40 toward its tripping position causes clockwise movement of the sear 44 against the opposing biasing force of the biasing mechanism 46. As the hammer assembly 28 attains its tripping position the sear 44 pivots out of engagement with the trigger allowing the hammer assembly to pivot in counterclockwise direction from its broken line position of FIG. 3 to its full line or striking position of FIG. 2 wherein the firing lug 66 engages the rim of an associated chambered round to fire it. When the trigger is released it is biased forwardly to its ready position by the trigger spring 36 to reset the firing mechanism to fire the next round.

We claim:

1. In a handgun having a frame and a firing mechanism including a trigger supported on the frame for movement between ready and firing positions, a hammer assembly supported on the frame for movement between striking and tripping positions, and a mainspring normally biasing the hammer toward its striking position, the hammer assembly including a hammer and a sear pivotally supported on the hammer and engageable with another part of the firing mechanism for moving the hammer assembly from its striking position to its tripping position and releasing the hammer in its tripping position in response to movement of the trigger from its ready position to its firing position, the improvement wherein said sear comprises a generally L-shaped member having two legs, one of said legs being engageable with said other part, and said handgun includes means independent of said other part and engageable with the other of said legs for releasing said sear from engagement with said other part at said tripping position to allow said hammer to move to its firing position in response to the biasing force of said mainspring, and means for biasing said one leg toward said other part and maintaining it in engagement with said other part until said sear means is released from engagement with said other part by engagement of said other leg with said independent means.

2. In a handgun as set forth in claim 1 the further improvement wherein said independent means comprises a first abutment in the path of said other leg.

3. In a handgun as set forth in either claim 1 or claim 2 wherein said other part comprises said trigger.

4. In a handgun as set forth in either claim 1 or claim 2 the further improvement wherein said independent means is further characterized as an abutment surface on said frame.

5. In a handgun as set forth in claim 4 the further improvement wherein said hammer assembly is disposed wholly within the confines of said frame.

6. In a handgun as set forth in claim 1 the further improvement wherein said L-shaped sear member is supported to pivot proximate the junction of said legs.

7. In a handgun as set forth in claim 6 the further improvement wherein said one leg has a forwardly facing abutment surface thereon engageable with a rearwardly facing bearing surface on said other part and said other leg has a rearwardly facing abutment surface thereon engageable with a forwardly facing bearing surface on said frame.

8. In a handgun as set forth in claim 7 the further improvement wherein said other part comprises said trigger.

9. In a handgun having a frame assembly and a firing mechanism, the frame assembly including a frame and a barrel assembly having a plurality of bores, each of the bores having an associated cartridge chamber, the firing mechanism including a trigger supported on the frame for movement between ready and firing positions, a hammer assembly supported on the frame for pivotal movement between striking and tripping positions, a mainspring normally biasing the hammer assembly toward its striking position, the hammer assembly including a hammer, and a firing element supported on the hammer for sequential rotary indexing movement relative to the hammer to positions of firing alignment with each successive one of the cartridge chambers, retaining means for securing the firing element in assembly with the hammer, sear means carried by the hammer and engageable with the trigger for moving the hammer assembly to and releasing it in its tripping position to move to its striking position in response to biasing force of the mainspring, means for biasing said sear means to a position wherein it is engageable with said trigger, and means for indexing the firing element in timed relation to movement of the hammer assembly between its striking and tripping positions, the improvement wherein said sear means comprises a generally L-shaped sear pivotally supported on said hammer and having two legs, one of said legs being engageable with said trigger, and said handgun includes means independent of said hammer and said trigger and having an abutment in the path of the other of said legs and engageable with said other leg for moving said sear out of engagement with said trigger as said hammer assembly reaches its tripping position.

10. In a handgun as set forth in claim 9 the further improvement wherein said abutment is defined by said frame.

11. In a handgun as set forth in either claim 9 or claim 10 wherein said L-shaped sear member is supported to pivot proximate the junction of said legs.

12. In a handgun having a frame and a firing mechanism including a trigger supported on the frame for movement between ready and firing positions, a hammer assembly supported on the frame for movement between striking and tripping positions, and a mainspring normally biasing the hammer toward its striking position, the hammer assembly including a hammer and a sear pivotally supported on the hammer and engageable with another part of the firing mechanism for moving the hammer assembly from its striking position to its tripping position and releasing the hammer in its tripping position in response to movement of the trigger from its ready position to its firing position, the improvement wherein said sear has two legs and is pivotally supported on said hammer at the junction of said legs, one of said legs being engageable with said other part, said handgun includes means independent of said other part and engageable with the other of said legs for releasing said sear from engagement with said other part at said tripping position to allow said hammer to move to its firing position in response to the biasing force of said mainspring, and means for biasing said one leg toward said other part and maintaining it in engagement with said other part until said sear is released from engagement with said other part by engagement of said other leg with said independent means.

13. In a handgun as set forth in claim 12 the further improvement wherein said other part comprises said trigger.

* * * * *